US007976449B2

(12) United States Patent
Klein

(10) Patent No.: US 7,976,449 B2
(45) Date of Patent: Jul. 12, 2011

(54) TRANSFER DEVICE FOR TRANSFERRING A FOLDING BOX

(75) Inventor: Stephan Klein, Karlsruhe (DE)

(73) Assignee: IWX Verpackungstechnik GmbH, Stutensee (DE)

( * ) Notice: Subject to any disclaimer, the term of this patent is extended or adjusted under 35 U.S.C. 154(b) by 302 days.

(21) Appl. No.: 12/311,430

(22) PCT Filed: May 21, 2008

(86) PCT No.: PCT/EP2008/004068
§ 371 (c)(1),
(2), (4) Date: Mar. 30, 2009

(87) PCT Pub. No.: WO2008/141815
PCT Pub. Date: Nov. 27, 2008

(65) Prior Publication Data

US 2009/0233779 A1 Sep. 17, 2009

(30) Foreign Application Priority Data

May 23, 2007 (DE) ..... 10 2007 023 964

(51) Int. Cl.
*B31B 1/76* (2006.01)

(52) U.S. Cl. ..... 493/318; 493/309; 493/315; 53/458; 53/564

(58) Field of Classification Search ..... 53/458, 53/564; 493/309, 313, 315, 318
See application file for complete search history.

(56) References Cited

U.S. PATENT DOCUMENTS 5,019,029 A * 5/1991 Calvert ..... 493/315
5,067,937 A * 11/1991 Aschaber et al. ..... 493/310
5,613,828 A * 3/1997 Haddow et al. ..... 414/798.9
5,715,657 A 2/1998 Mondani
5,928,123 A * 7/1999 Davis, Jr. ..... 493/316
7,404,788 B2 * 7/2008 Monti ..... 493/316
7,441,764 B2 * 10/2008 Thierry et al. ..... 271/94
7,603,835 B2 * 10/2009 Caporale ..... 53/564
(Continued)

FOREIGN PATENT DOCUMENTS

DE 29 23 909 12/1980
(Continued)

*Primary Examiner* — Christopher Harmon
(74) *Attorney, Agent, or Firm* — Paul Vincent

(57) ABSTRACT

A transfer device for transferring a folding box from a magazine that accommodates flat folding boxes, to a transport device comprises a holding device which takes over the folding box, holds it during transfer, and can be moved along a cycloid path having several turning points and intermediate curved sections. The transfer device comprises a basic lever which performs a continuous steady rotary motion, a first lever pair comprising a first lever which is pivotably disposed on the basic lever via a first joint, and a second lever which is pivotably disposed on the first lever via a second joint, and a second lever pair comprising a third lever which is pivotably disposed on the basic lever via a third joint, and a fourth lever which is pivotably disposed on the third lever via a fourth joint. The holding device is mounted to a holding block which is pivotably connected to the second lever of the first lever pair via a further joint. A pivotably disposed guiding part is provided, which has a linear guidance. A carriage part is formed on the holding block, which is seated on the linear guidance and can be moved along the linear guidance. The first lever pair has a first curve roller which is in engagement with a first control cam, and the second lever pair has a second curve roller which is in engagement with a second control cam.

6 Claims, 9 Drawing Sheets

U.S. PATENT DOCUMENTS

| | | | | |
|---|---|---|---|---|
| 7,695,421 | B2 * | 4/2010 | Ford | 493/315 |
| 2002/0028127 | A1 * | 3/2002 | Hart et al. | 414/788.1 |
| 2006/0160686 | A1 * | 7/2006 | Thierry et al. | 493/315 |

FOREIGN PATENT DOCUMENTS

| | | |
|---|---|---|
| DE | 36 06 093 | 8/1987 |
| DE | 28 11 159 | 2/1989 |
| DE | 38 25 899 | 2/1989 |
| DE | 40 29 520 | 3/1992 |
| DE | 42 04 993 | 2/1993 |
| DE | 692 08 283 | 7/1996 |
| DE | 198 01 194 | 7/1999 |
| EP | 0 134 628 | 3/1985 |
| EP | 0 434 961 | 7/1991 |
| EP | 0 590 568 | 4/1994 |
| GB | 2 429 965 | 3/2007 |
| WO | WO 2004/074108 | 9/2004 |
| WO | WO 2007/015049 | 2/2007 |

* cited by examiner

TRANSFER DEVICE FOR TRANSFERRING A FOLDING BOX

This application is the national stage of PCT/EP2008/004068 filed on May 21, 2008 and also claims Paris Convention priority of DE 10 2007 023 964.7 filed May 23, 2007.

BACKGROUND OF THE INVENTION

The invention concerns a transfer device for transferring a folding box from a magazine that accommodates flat folding boxes, to a transport device, thereby simultaneously erecting it, comprising a holding device which takes over the folding box, holds it during transfer, and can be moved along a cycloid path having several turning points and intermediate curved sections.

A transfer device of this type is used e.g. in a cartoning machine, in which a folding box, which is accommodated in a flat, folded state in a magazine, must first be erected prior to delivery of the product to be packed, and be provided in a transport device which is usually designed as a belt conveyor or chain conveyor.

Towards this end, as disclosed e.g. in DE 198 01 194 A1, each folding box is removed from the magazine using a holding device which is designed, in particular, in the form of a suction device and disposed on a revolving planetary part of a removing device, which runs on a sun wheel and is supplied therewith along a cycloid path to the transport device and disposed in a cell formed between two fingers which are disposed at that location. During the motion along the cycloid path, an erecting element, which is disposed on the planetary part, is brought into abutment with the folding box, thereby erecting the folding box.

It has turned out that a simple planetary gear that is used in the transfer device cannot ensure long-term reliable transfer of the folding box to the transport device. For this reason, one tried to optimize the course of the cycloid path e.g. by moving the sun wheel forwards or backwards in a cyclic fashion, or by providing a second sun wheel with a further planetary part, wherein the two sun wheels can be adjusted relative to each other, thereby permitting adjustment of the motions as desired. In accordance with DE 198 01 194 A1, one rotary correction motion both for the rotary motion of the holding device and also for the rotary motion of the erecting element is picked up on independent control cams and overlaid with the respective rotary motion resulting from the rotation of the planetary part. In all cases, the constructive expense in order to obtain the cycloid path is very high, thereby rendering the transfer devices not only expensive but, in particular, also susceptible to malfunction.

It is the underlying purpose of the invention to provide a transfer device of the above-mentioned type, which has a simple construction and ensures reliable transfer of the folding box to the transport device.

SUMMARY OF THE INVENTION

This object is achieved by a transfer device of the above-mentioned type, which comprises the following features:

- a basic lever is provided, which performs a continuous steady rotary motion;
- a first lever pair is provided comprising a first lever which is pivotably disposed on the basic lever via a first joint, and a second lever which is pivotably disposed on the first lever via a second joint;
- a second lever pair is provided comprising a third lever which is pivotably disposed on the basic lever via a third joint, and a fourth lever which is pivotably disposed on the third lever via a fourth joint;
- a holding block is provided to which the holding device is mounted and which is pivotably connected to the second lever of the first lever pair via a further joint;
- a pivotably disposed guiding part is provided, which has a linear guidance e.g. a rail or a guiding groove;
- a carriage part is formed on the holding block, which is seated on the linear guidance and can be moved along the linear guidance;
- the first lever pair has a first curve roller which is in engagement with a first control cam; and
- the second lever pair has a second curve roller which is in engagement with a second control cam.

In accordance with the invention, the planetary gear, which is normally used in conventional transfer devices, is replaced by a lever mechanism. It is based on a basic lever which is continuously turned at uniform speed by a suitable drive. Two lever pairs, which are each formed by two levers, are disposed on the basic lever, wherein each lever is articulated on both sides. In order to urge the levers to perform defined motions and defined relative positions during passage of the entire cycloid path, the first lever pair is associated with a first curve roller, which is in engagement with a first control cam. The second lever pair is additionally associated with a second curve roller which is in engagement with a second control cam. The free end of the second lever of the first lever pair is pivotably disposed on a holding block via a further joint, to which the holding device is mounted. The holding device preferably comprises a normal suction device that can be activated by applying an underpressure.

The pivotably disposed guiding part is provided for controlling the pivot motion of the holding block about the further joint, which has a linear guidance, e.g. a rail or a guiding groove. A carriage part is formed on the holding block, which is seated on the linear guidance and can be moved along the linear guidance. The guiding part is provided with a linear guidance, such that the motions of the individual components can be overlaid in such a fashion that the holding device performs a linear motion at the folding box magazine perpendicularly to the surface of the folding boxes, stacked in the magazine, at the turning point of the cycloid path, thereby ensuring reliable removal of the lowermost folding box of the folding box stack and reliably preventing the removed folding box from striking the magazine. A similar linear motion can also be obtained at a turning point of the cycloid path close to a counter suction device and/or at the turning point of the cycloid path when the erected folding box is disposed on the transport device.

In one feasible embodiment of the invention, the free ends of the second lever and fourth lever are connected to each other via the further joint, such that the two lever pairs form a four-bar linkage.

The fourth lever of the second lever pair may alternatively be articulated to the guiding part via a guiding joint, while, as mentioned above, the second lever of the first lever pair is pivotably connected to the holding block via the further joint. This embodiment is advantageous in that the motions that the two control cams impose on the respective lever pairs are independent of each other, which improves adjustment of the motions and, in particular, separates the radial motion of the holding device from the rotary motion. It is thereby possible that the linear guidance stops for a short time period, such that the folding box can be removed from the magazine with a pure linear motion.

The guiding part can be pivoted about an axis which extends parallel to the drive axis of the basic lever. These two axes preferably coincide, such that the guiding part can be pivoted about the drive axis of the basic lever.

In one feasible embodiment of the invention, the holding device is not directly seated on the holding block but mounted to an arm which preferably extends in the longitudinal direction of the drive axis parallel thereto and parallel to a pivot axis of the holding block.

BRIEF DESCRIPTION OF THE DRAWING

Further details and features of the invention can be extracted from the following description of an embodiment with reference to the drawing. In the drawing.

DESCRIPTION OF THE PREFERRED EMBODIMENT

Figure 1:
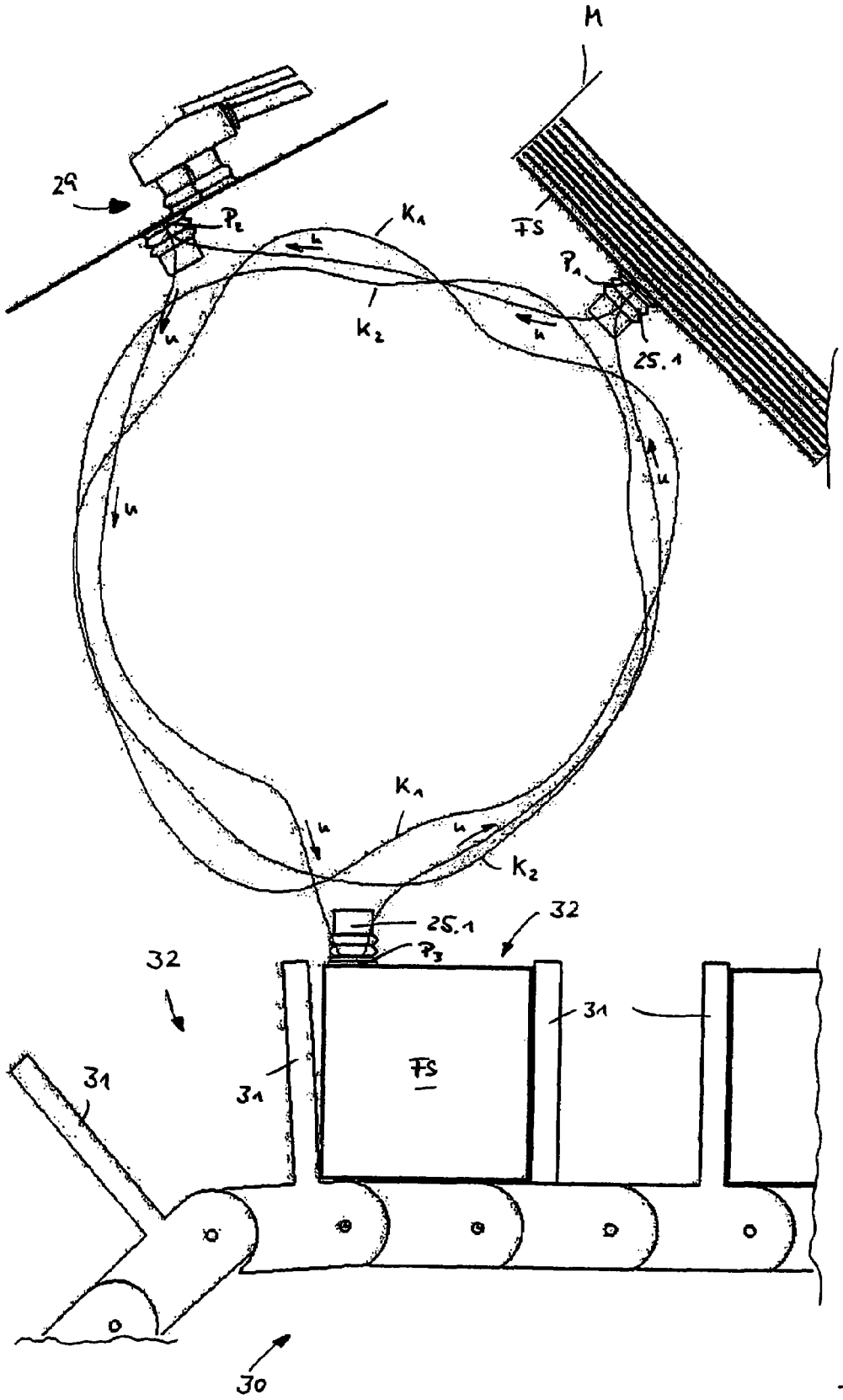
FIG. 1 shows a schematic view of the surroundings of a transfer device in a cartoning machine with the cycloid path and the control cams.

FIG. 1 shows the basic arrangement of a transfer device 10 within a cartoning machine. The cartoning machine has a revolving transport device 30, e.g. in the form of a chain conveyor, which has several fingers 31 that are disposed at a separation from each other and between which the cells 32 are formed. One erected folding box FS can be disposed into each cell 32. The transport device 30 is filled with folding boxes from the top, wherein its transport direction F extends substantially in a horizontal direction.

The transfer device 10 is provided above the transport device 30. FIG. 1 only shows a suction device 25.1 of a holding device in different positions on a cycloid path Z. The cycloid path Z comprises three turning points $P_1$, $P_2$, $P_3$ which lie on the corner points of an approximately equilateral triangle. The direction of circulation along the cycloid path Z is substantially the anticlockwise direction, as indicated by the arrows u. The right-hand upper side of FIG. 1 shows the state of the holding device in which the suction device 25.1 is located in the upper turning point $P_1$ which is associated with a magazine M in which the folding boxes FS are accommodated and stacked in a flat, folded state. When the suction device 25.1 comes into engagement with the lower folding box FS of the folding box stack of the magazine M, the suction device 25.1 is activated, thereby grasping the lower folding box FS of the magazine M. The suction device 25.1 is subsequently moved together with the folding box M on a first curved section of the cycloid path Z towards the second turning point $P_2$, where an opening or counter suction device 29 is disposed. When the second turning point $P_2$ has been reached (FIG. 1, upper left-hand region), the folding box FS is brought into abutment with the stationary opening or counter suction device 29, whereby the folding box M is slightly opened as the suction device 25.1 continues to move on the cycloid path Z, thereby increasing the distance to the counter suction device 29.

At the end of the motion along the second curved section of the cycloid path Z between the second turning point $P_2$ and the third turning point $P_3$, i.e. when the third turning point $P_3$ has been reached, where the folding box FS is transferred to the transport device 30, the suctioning surface of the suction device 25.1 bearing the folding box FS is oriented substantially in a horizontal direction and therefore extends parallel to the transport direction F of the transport device 30 (FIG. 1, lower portion). During the motion between the second turning point $P_2$ and the third turning point $P_3$, an erecting element (known per se and not illustrated), which forms an erecting stop, is conventionally brought into abutment with the folding box FS, thereby erecting the folding box.

At the turning point $P_3$, the folding box M can be inserted from the top into the cell 32 formed between two fingers 31 of the transport device 30, wherein the orientation of the cycloid path Z relative to the transport device 30 is advantageous in that the suction device 25.1 and thereby the folding box FS have a motion component in the transport direction F upon approaching the third point of reversal $P_3$, where the folding box is transferred. After delivery of the folding box to the transport device 30, the holding device 24 and suction device 25.1 return on a third curved section of the cycloid path Z to the magazine (FIG. 1, right-hand upper side), whereupon the cycle is repeated.

Figure 2:
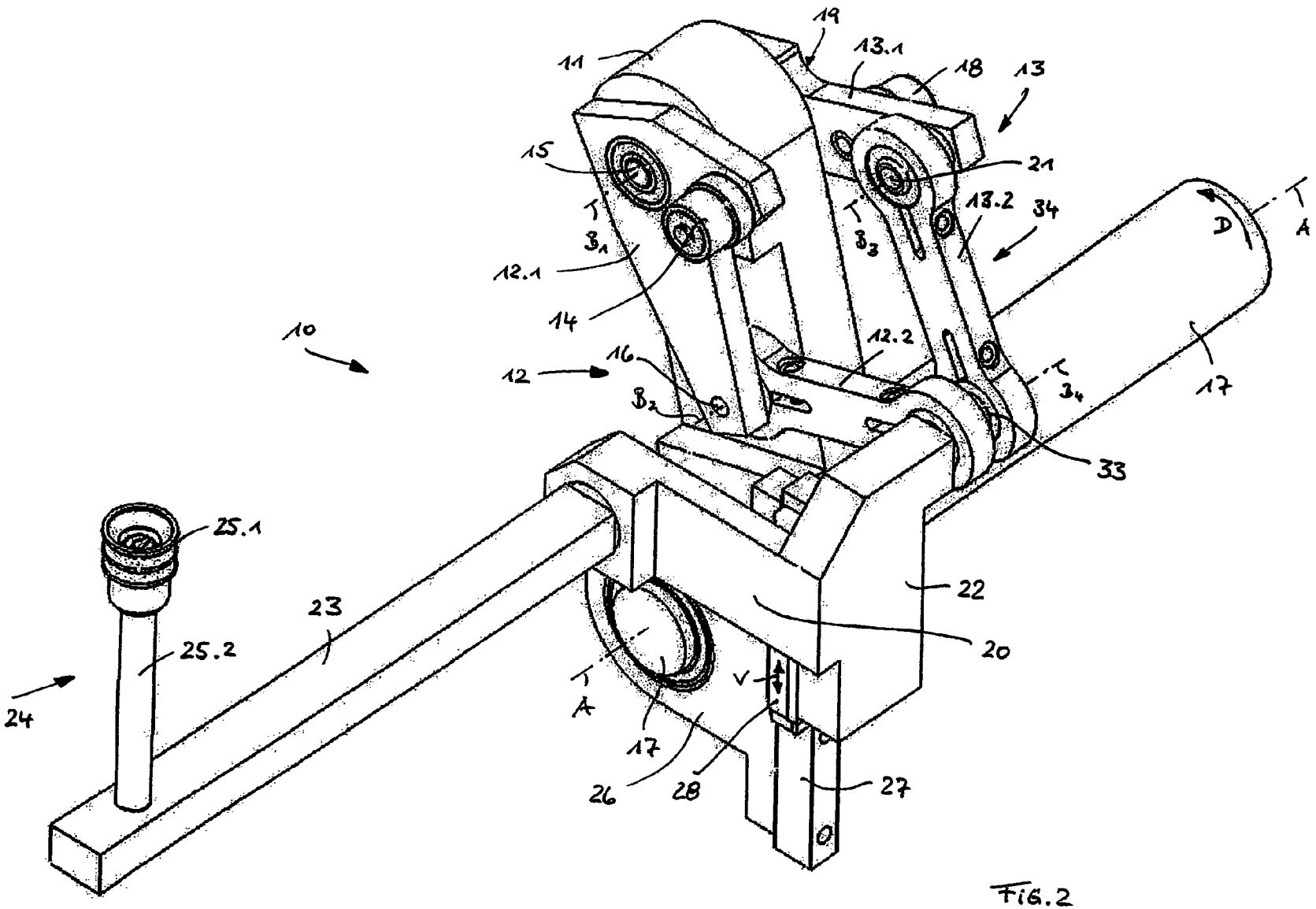
FIG. 2 shows a perspective view of a first embodiment of the inventive transfer device.
Figure 8:
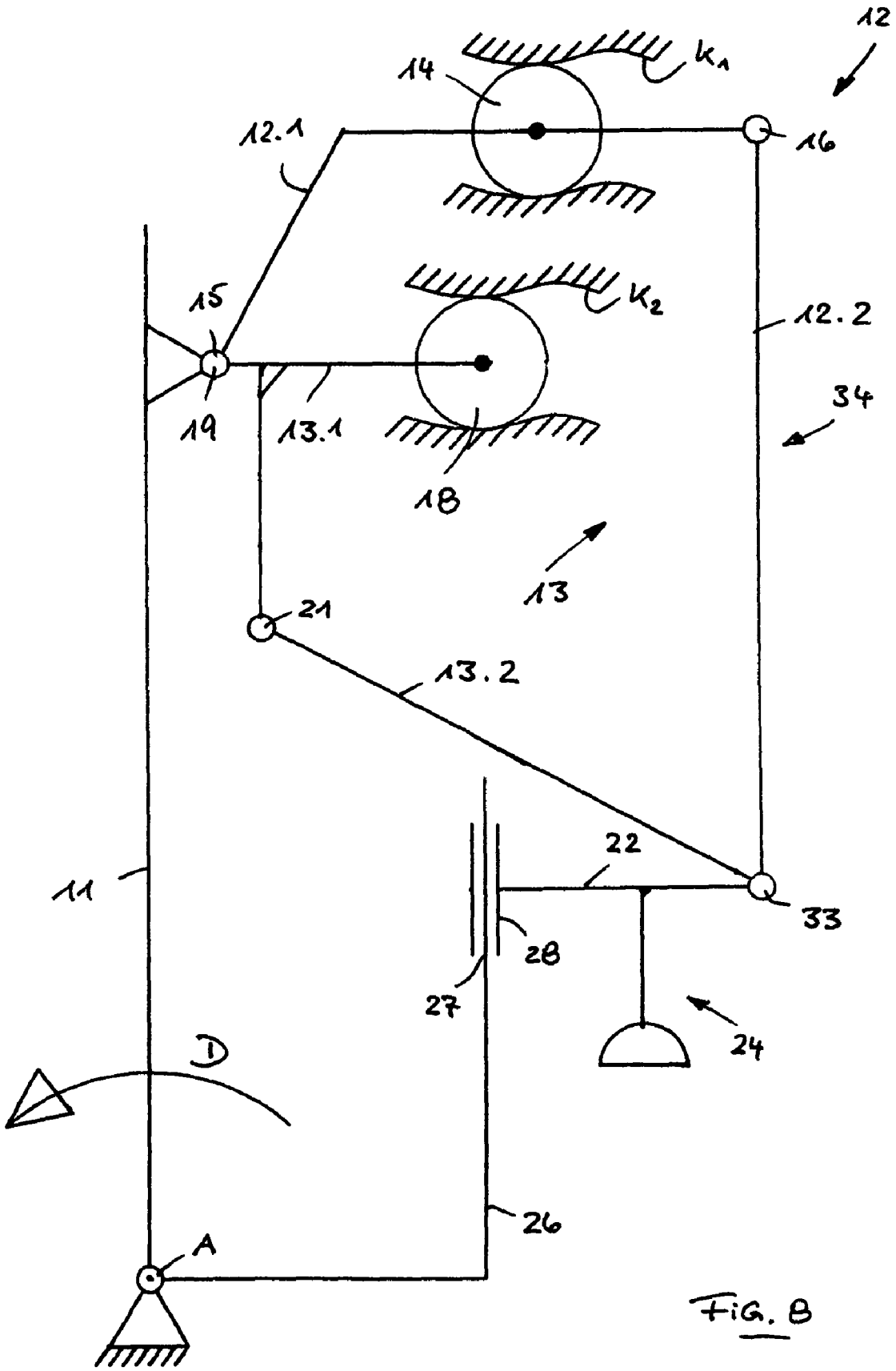
FIG. 8 shows a schematic view of the kinematic design of the transfer device in accordance with a first embodiment.

FIG. 2 shows a perspective view of a first embodiment of the transfer device 10 which is designed as a lever mechanism. FIGS. 3 through 7 show the mutual arrangement of the levers of the transfer device 10 at different positions on the cycloid path Z. FIG. 8 schematically shows the kinematic construction of the transfer device.

A basic lever 11, which is oriented substantially perpendicularly with respect to the drive axis A, is seated on a drive shaft 17 which performs a continuous steady rotary motion of constant rotational speed (arrow D) about a drive axis A. A first lever pair 12 is articulated to the basic lever 11 close to its end facing away from the drive axis A. The first lever pair 12 comprises a first lever 12.1 which is disposed on the basic lever 11 via a first joint 15, wherein a pivot axis $B_1$ of the first joint 15 extends parallel to the drive axis A. Close to the first joint 15, the first lever 12.1 bears a first curve roller 14, which is in engagement with a first curved path $K_1$ (FIG. 1).

At its end facing away from the first joint 15, the first lever 12.1 is also articulated to a second lever 12.2 via a second joint 16 whose pivot axis $B_2$ also extends parallel to the drive axis A.

A second lever pair 13 is connected to the basic lever 11 on its side facing away from the first lever pair 12. The second lever pair 13 comprises a third lever 13.1 which is articulated to the basic lever 11 at a third joint 19 (not shown in FIG. 2), wherein a pivot axis of the third joint 19 advantageously coincides with the pivot axis $B_1$ of the first joint 15.

The third lever 13.1 carries a second curve roller 18, which is in engagement with a second curved path $K_2$ (see FIG. 1). At its end facing away from the third joint 19, the third lever 13.1 is articulated to a fourth lever 13.2 via a fourth joint 21 whose pivot axis $B_3$ extends parallel to the drive axis A.

The free end of the second lever 12.2. facing away from the second joint 16 and the free end of the fourth lever 13.2 facing away from the fourth joint 21 are articulated to each other via a further joint 33 whose pivot axis $B_4$ extends parallel to the drive axis A. The two lever pairs 12 and 13 or the four levers

12.1, 12.2, 13.1 and 13.2 together thereby form a four-bar linkage 34 or a parallel four-bar linkage.

A holding block 22 is articulated to the four-bar linkage 34 in the further joint 33, which can pivot about the pivot axis $B_4$. The holding block 22 carries a transversely extending projection 20 to which an arm 23 is mounted which extends in the longitudinal direction of the drive axis A offset therefrom and carries the holding device 24 at its front free end, which comprises a rod-shaped holder 25.2 which extends perpendicularly with respect to the longitudinal direction of the arm 23, at the upper free end of which the suction device 25.1 is disposed.

The holding block 22 has a carriage part 28 which is seated on a linear guidance 27 such that it can be displaced in a longitudinal direction, as indicated in FIG. 2 with the double arrow V. The linear guidance 27 is part of a guiding part 26 which is pivotably seated on the drive shaft 17 and can thereby perform a pivot motion about the drive axis A.

Figure 3:
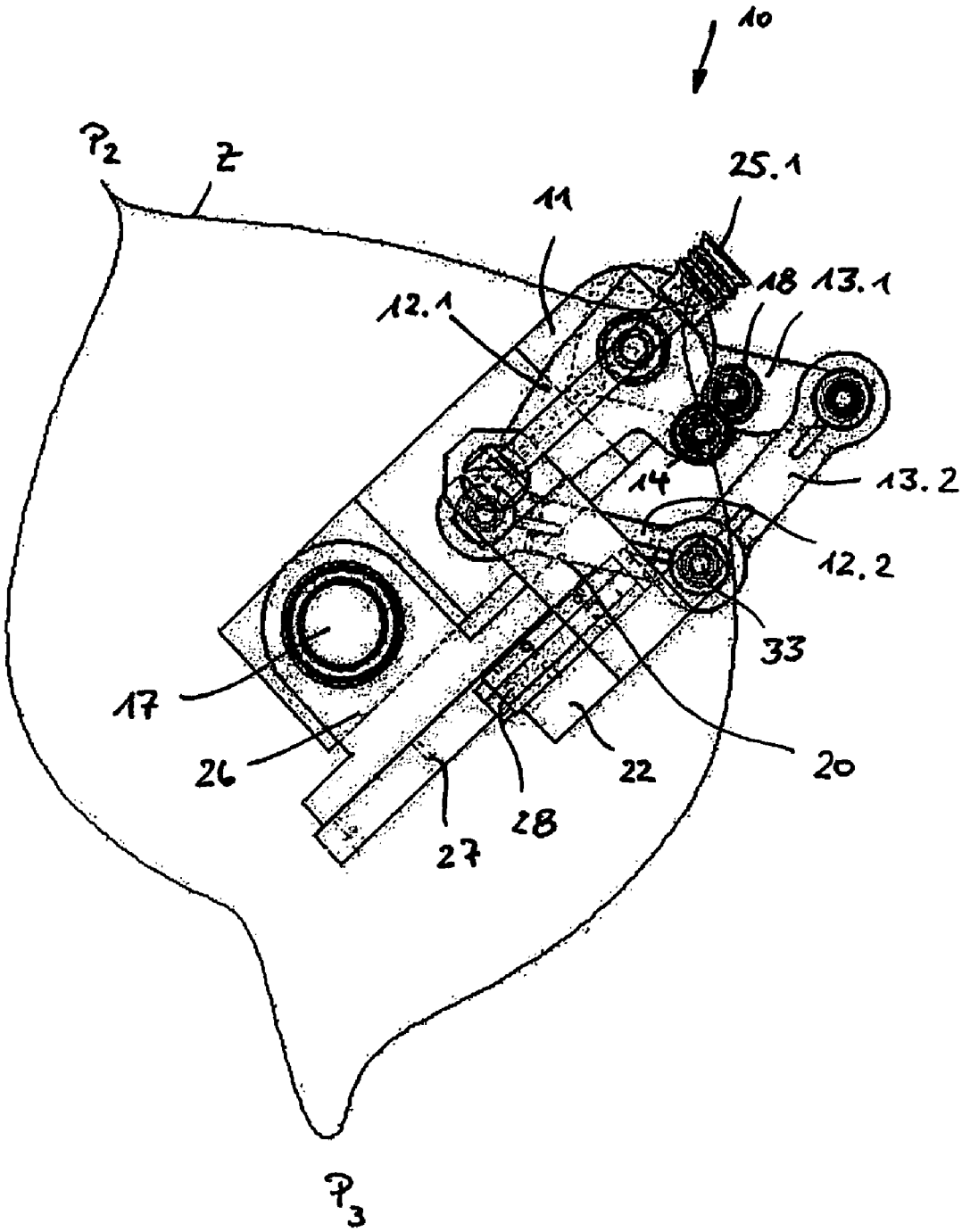
FIG. 3 shows the transfer device in accordance with FIG. 2 during removal of a folding box from the magazine.
Figure 4:
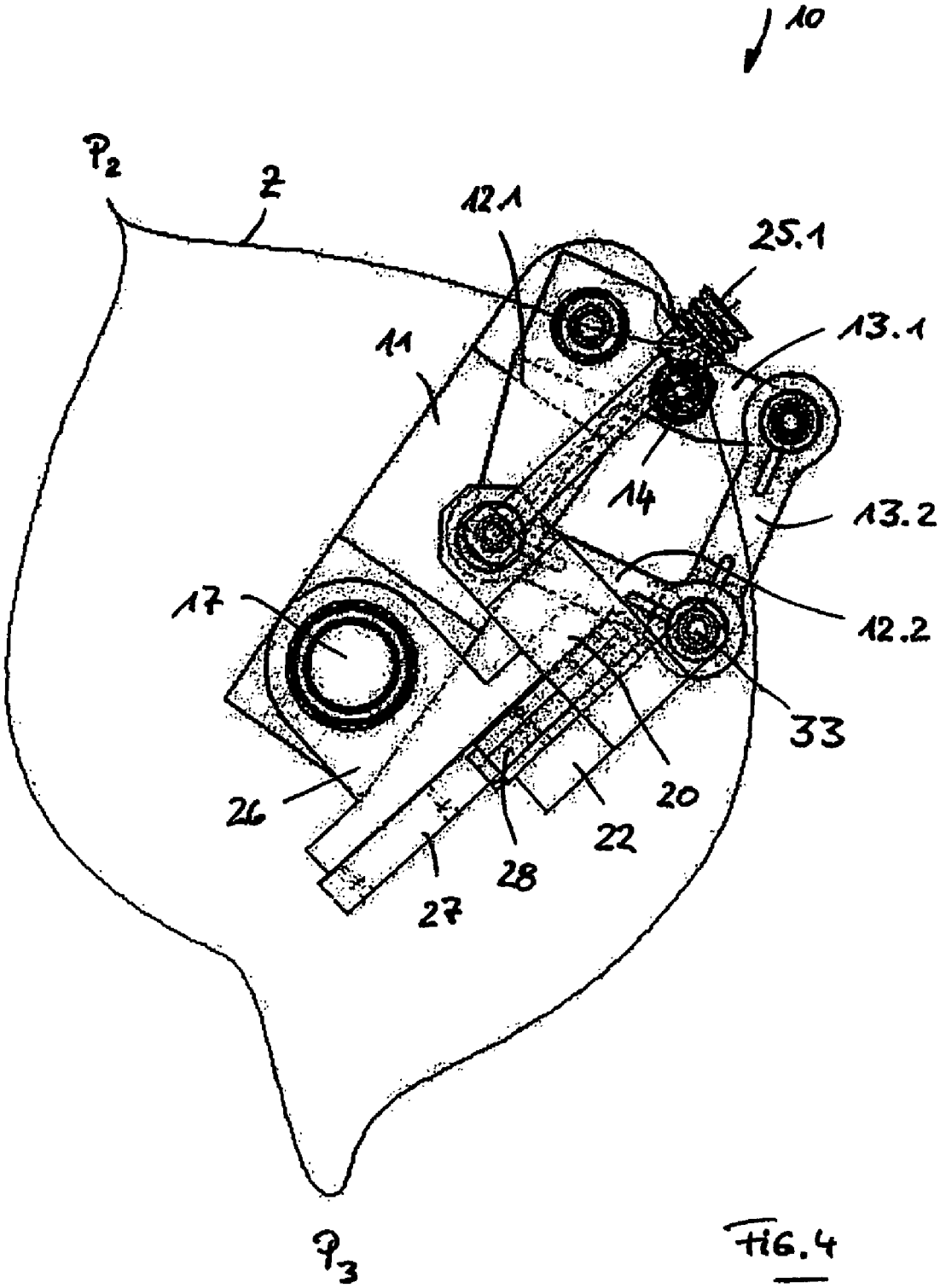
FIG. 4 shows the transfer device directly after removal of the folding box from the magazine.
Figure 5:
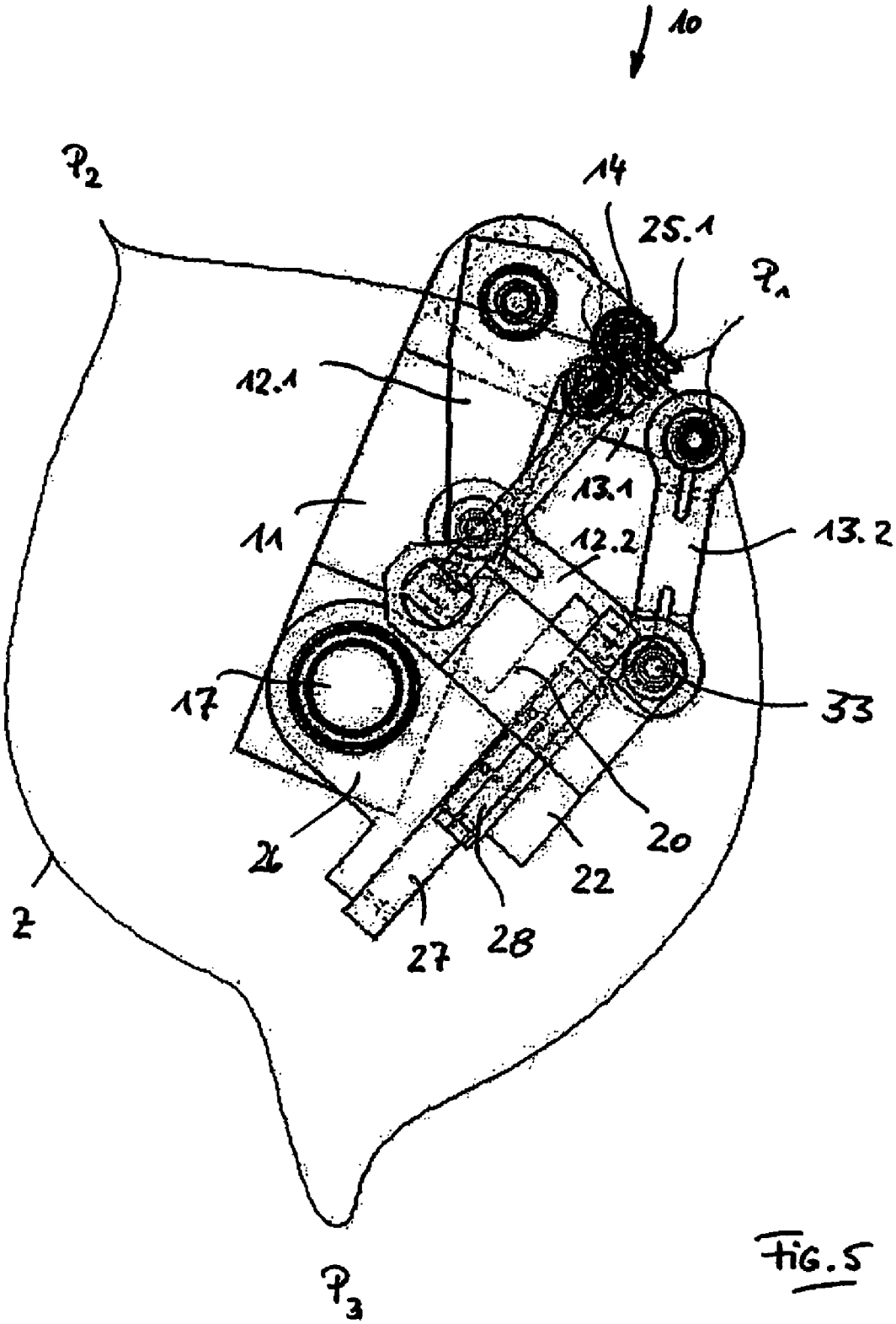
FIG. 5 shows the transfer device shortly after the position of FIG. 4.
Figure 6:
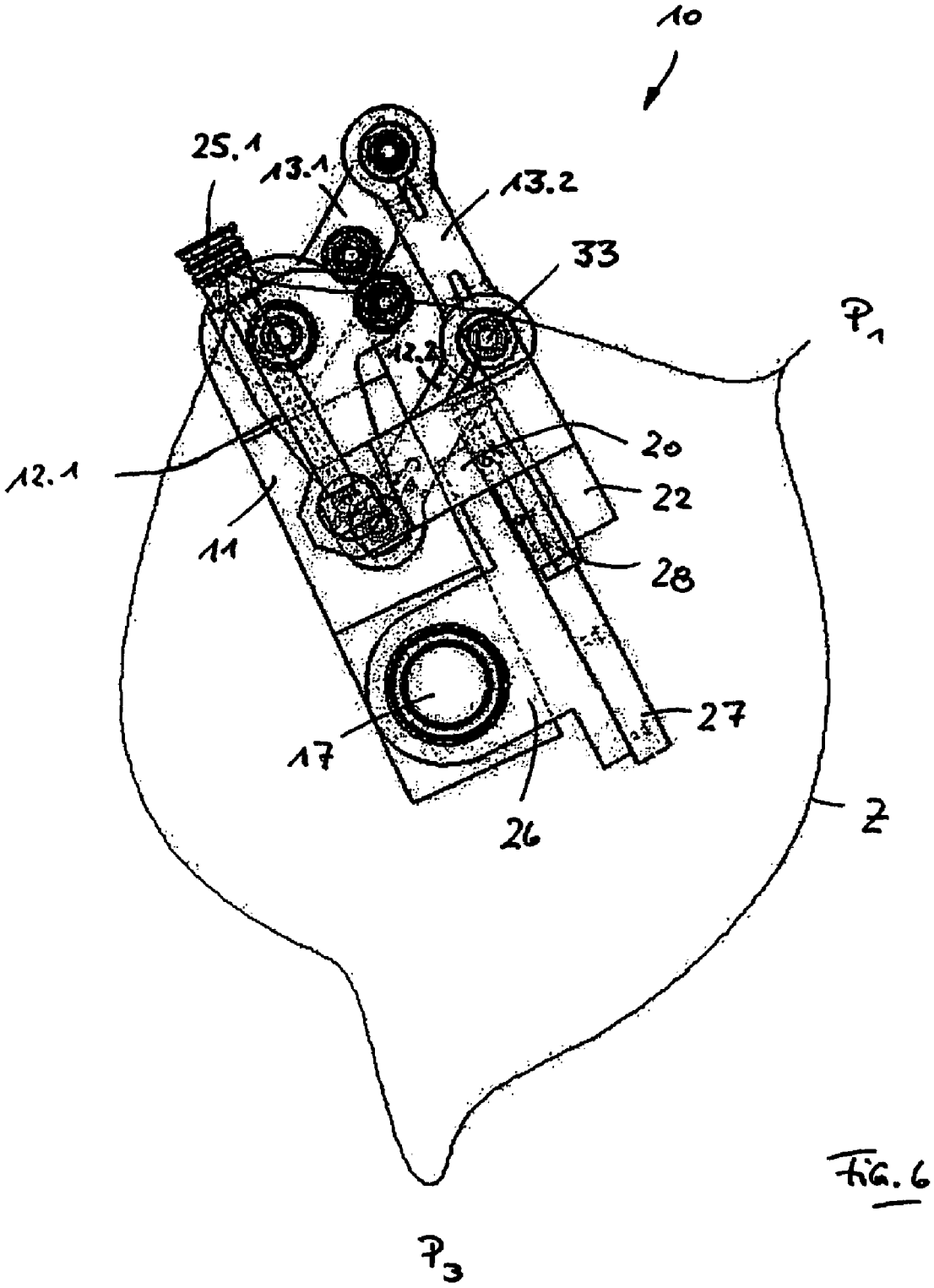
FIG. 6 shows the transfer device when the folding box abuts the counter suction device.
Figure 7:
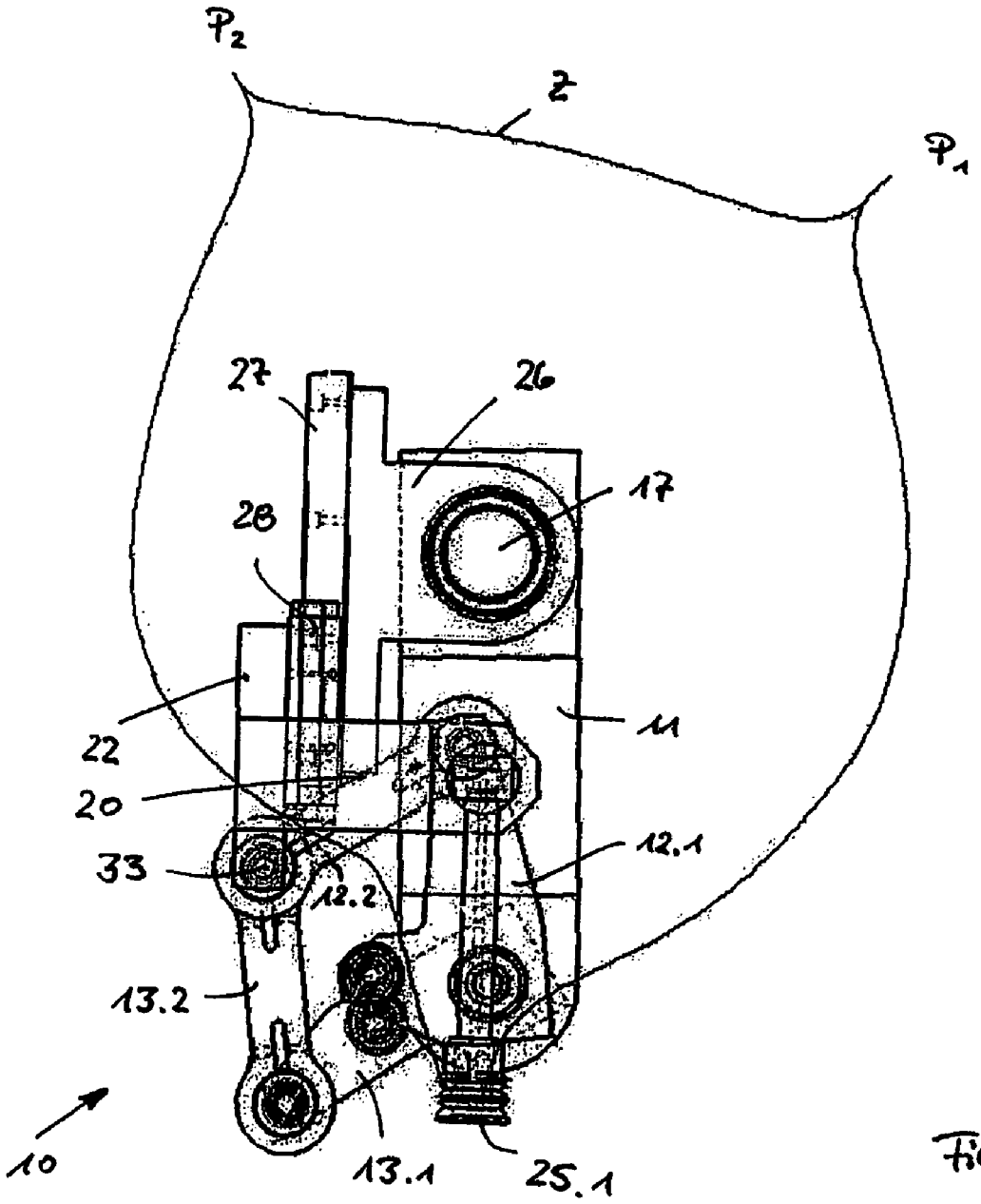
FIG. 7 shows the transfer device when the folding box is disposed on the transport device.

FIGS. 3 through 7 show the inventive transfer device in different states along the cycloid path Z. They show that the suction device 25.1 of the holding device 24 is oriented radially outwardly in all states. In particular, FIGS. 3 through 5 show that the inventive embodiment and, in particular, the arrangement of the linear guidance 27 ensure that the entire suction surface of the suction device 25.1, which grasps the folding box FS in the magazine M, comes into abutment with the surface of the lower folding box and, in the further course of the motion, initially performs a purely translatory motion on a straight path although the basic lever 11 performs a further pivot motion (shown in FIGS. 3, 4 and 5). At the turning point $P_2$, a corresponding linear approach to the counter suction device 29 takes place.

Figure 9:
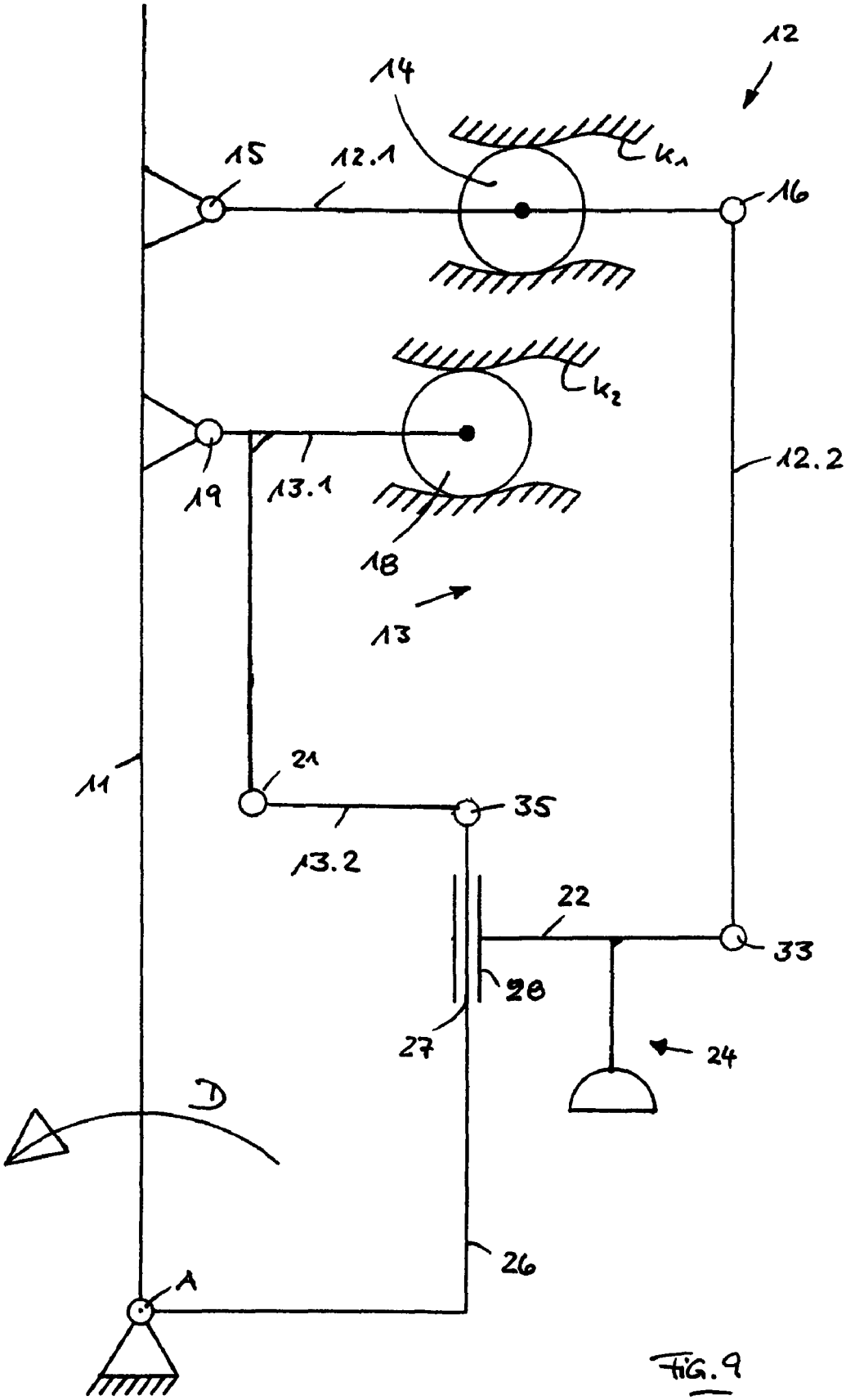
FIG. 9 shows a schematic view of the kinematic design of the transfer device in accordance with a second embodiment.

The figures show the transfer device 10 with only one four-bar linkage and one suction device. The transfer device may, however, also be provided with several suction devices which are distributed over the periphery and each have a four-bar linkage. The curve rollers of all four-bar linkages may thereby be guided in the same curved paths $K_1$ and $K_2$. FIG. 9 shows a schematic view, analogous to FIG. 8, of the kinematic configuration of the transfer device in accordance with a second design. Essential elements of this second design are identical to the first design of FIG. 8. This design differs from FIG. 8 i.a. in that the first joint 15 of the first lever 12.1 and the third joint 19 of the third lever 13.1 are formed at different locations of the basic lever 11. A design of this type is also feasible for the first embodiment in accordance with FIG. 8 and conversely, the first joint 15 and the third joint 19 of the second embodiment may coincide with their axis of rotation.

The substantial difference between the second embodiment in accordance with FIG. 9 and the first embodiment in accordance with FIG. 8 consists in that the front end of the fourth lever 13.2 of the second lever pair 13, which faces away from the third lever 13.1, is then articulated to the guiding part 26 via a guiding joint 35, such that the two lever pairs 12 and 13 no longer form a four-bar linkage.

The second lever 12.2 of the first lever pair 12 is furthermore articulated, via the further joint 33, to the holding block 22, the carriage part 28 of which can be moved along the linear guidance 27 of the guiding part 26.

I claim:

1. A transfer device for transferring a folding box from a magazine that accommodates flat folding boxes to a transport device, thereby simultaneously erecting the box, and with a holding device which takes over the folding box to hold the box during transfer thereof, the holding device moving along a cycloid path having several turning points and intermediate curved sections, the transfer device comprising:

a basic lever structured to perform a continuous, steady rotary motion;

a first lever pair comprising a first lever which is pivotably disposed on said basic lever via a first joint and a second lever which is pivotably disposed on said first lever via a second joint;

a second lever pair comprising a third lever which is pivotably disposed on said basic lever via a third joint and a fourth lever which is pivotably disposed on said third lever via a fourth joint;

a holding block to which the holding device is mounted, said holding block pivotably connected to said second lever of said first lever pair via a further joint; and a pivotably disposed guiding part having a linear guidance, wherein a carriage part, formed on said holding block, is disposed, structured and dimensioned to seat on and move along said linear guidance;

a first curve roller cooperating with said first lever pair;

a first control cam cooperating with said first curve roller;

a second curve roller cooperating with said second lever pair; and a second control cam cooperating with said second curve roller.

2. The transfer device of claim 1, wherein free ends of said second lever and of said fourth lever are connected to each other via said further joint, wherein said first and said second lever pairs form a four-bar linkage.

3. The transfer device of claim 1, wherein said fourth lever of said second lever pair is articulated to said guiding part via a guiding joint.

4. The transfer device of claim 1, wherein said guiding part pivots about a drive axis of said basic lever.

5. The transfer device of claim 1, wherein the holding device is mounted to an arm which extends parallel to a pivot axis of said holding block.

6. The transfer device of claim 1, wherein the holding device comprises a suction device.

* * * * *